US010050364B1

(12) United States Patent
Morino et al.

(10) Patent No.: US 10,050,364 B1
(45) Date of Patent: Aug. 14, 2018

(54) FLEXIBLE PRINTED CIRCUIT CONNECTOR AND ELECTRONIC DEVICE PROVIDED WITH THE SAME

(71) Applicant: LENOVO (SINGAPORE) PTE. LTD., Singapore (SG)

(72) Inventors: Takayuki Morino, Yokohama (JP); Yoshiharu Uchiyama, Yokohama (JP); Masaaki Bandoh, Yokohama (JP); Toshihiro Inoue, Yokohama (JP)

(73) Assignee: LENOVO (SINGAPORE) PTE. LTD., Singapore (SG)

( * ) Notice: Subject to any disclaimer, the term of this patent is extended or adjusted under 35 U.S.C. 154(b) by 0 days.

(21) Appl. No.: 15/697,797

(22) Filed: Sep. 7, 2017

(30) Foreign Application Priority Data

Jul. 19, 2017 (JP) ..... 2017-139742

(51) Int. Cl.

| | |
|---|---|
| ***H01R 13/62*** | (2006.01) |
| ***H01R 12/87*** | (2011.01) |
| ***H01R 12/77*** | (2011.01) |
| ***H01R 12/88*** | (2011.01) |
| *H01R 43/24* | (2006.01) |
| *H01R 12/79* | (2011.01) |
| *H01R 12/89* | (2011.01) |

(52) U.S. Cl.
CPC ..... *H01R 12/87* (2013.01); *H01R 12/771* (2013.01); *H01R 12/88* (2013.01); *H01R 12/79* (2013.01); *H01R 12/89* (2013.01); *H01R 43/24* (2013.01)

(58) Field of Classification Search
CPC ..... H01R 12/79; H01R 12/87; H01R 12/88; H01R 13/193
USPC ..... 439/495, 260, 261, 67, 77
See application file for complete search history.

(56) References Cited

U.S. PATENT DOCUMENTS

| | | | | |
|---|---|---|---|---|
| 6,431,907 | B1 * | 8/2002 | Ma | H01R 12/79 439/260 |
| 7,887,351 | B2 * | 2/2011 | Wang | H01R 12/88 439/260 |
| 2013/0309887 | A1 * | 11/2013 | Honda | H01R 13/193 439/260 |

FOREIGN PATENT DOCUMENTS

JP 2017068736 A 4/2017

* cited by examiner

*Primary Examiner* — Abdullah Riyami
*Assistant Examiner* — Justin Kratt
(74) *Attorney, Agent, or Firm* — Shimokaji IP

(57) ABSTRACT

A connector capable of connecting a flat cable accurately is provided and includes: a main body to which the terminal of a flat cable having notches formed on both sides can be connected; and an actuator having engaging portions engageable with the notches, respectively, to sandwich the flat cable with the main body so as to retain the flat cable in a connecting position. The actuator is configured to insert the engaging portions into the notches in a first position, and move to a second position in such a state that the engaging portions are engaged with the notches in order to draw the flat cable into a connecting position.

4 Claims, 5 Drawing Sheets

FLEXIBLE PRINTED CIRCUIT CONNECTOR AND ELECTRONIC DEVICE PROVIDED WITH THE SAME

FIELD OF THE INVENTION

The present invention relates to a connector and an electronic device provided with the same.

BACKGROUND OF THE INVENTION

FPC (Flexible Printed Circuit) connectors are often used for electrical connections of an internal board in a portable electronic device such as a laptop personal computer (laptop PC), a tablet personal computer (tablet PC), or a smartphone (see Patent Document 1).

Among the FPC connectors, there is a ZIF (Zero Insertion Force) type that closes an actuator to sandwich and fix a flat cable (e.g., FFC: Flexible Flat Cable).

[Patent Document 1] Japanese Patent Application Laid-Open No. 2017-68736

SUMMARY OF THE INVENTION

The ZIF type FPC connector does not require a great force at the time of connection, and this can prevent some pins from dropping out or being bent. However, since the flat cable can be fixed by closing the actuator, the flat cable will be apparently fixed even if the connection is imperfect. Therefore, a contact failure may be caused by inserting the flat cable obliquely into the connector, or the flat cable may be connected in a flexed state (a so-called tilted state) due to the extra length of the flat cable.

The present invention has been made in view of the above circumstances, and it is an object thereof to provide a connector capable of connecting a flat cable accurately and an electronic device provided with the same.

In order to solve the above problems, the connector of the present invention and the electronic device provided with the same adopt the following aspects.

A connector according to the first aspect of the present invention includes: a main body to which the terminal of a flat cable having notches formed on both sides can be connected; and an actuator having engaging portions engageable with the notches, respectively, to sandwich the flat cable with the main body so as to retain the flat cable in a connecting position, wherein the actuator is configured to insert the engaging portions into the notches in a first position and move to a second position in such a state that the engaging portions are engaged with the notches in order to draw the flat cable into the connecting position.

It is also preferred that the main body should include a fitting portion to be fitted in the second position into a recessed portion formed in the actuator.

It is further preferred that the fitting portion should be made of metal and have a covering section to cover the main body.

An electronic device according to the second aspect of the present invention includes the connector according to the above first aspect.

In the above-described aspects of the present invention, since the flat cable is drawn in by means of the engaging portions provided in the actuator, the flat cable can be connected to the connector accurately.

DETAILED DESCRIPTION OF THE INVENTION

One embodiment of a connector and an electronic device provided with the connector of the present invention will be described below with reference to the accompanying drawings.

As the electronic device, for example, there is a laptop personal computer (laptop PC), a tablet personal computer (tablet PC), a smartphone, or the like.

Figure 1:
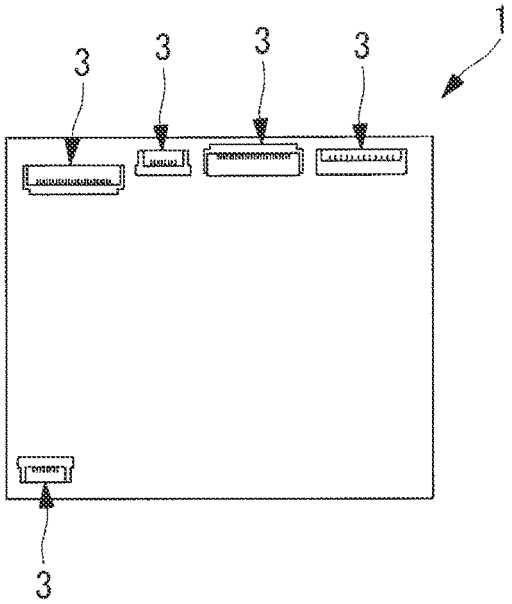
FIG. 1 is a plan view illustrating a board on which connectors according to one embodiment of the present invention are arranged.

FIG. 1 illustrates an example of a board 1 incorporated in the electronic device. On the board 1, plural connectors 3 are used for input/output of electrical signals. As connectors 3, ZIF (Zero Insertion Force) type FPC (Flexible Printed Circuit) connectors are used. Though not illustrated, various electronic components such as a processor and a memory can be mounted on the board 1.

Figure 2:
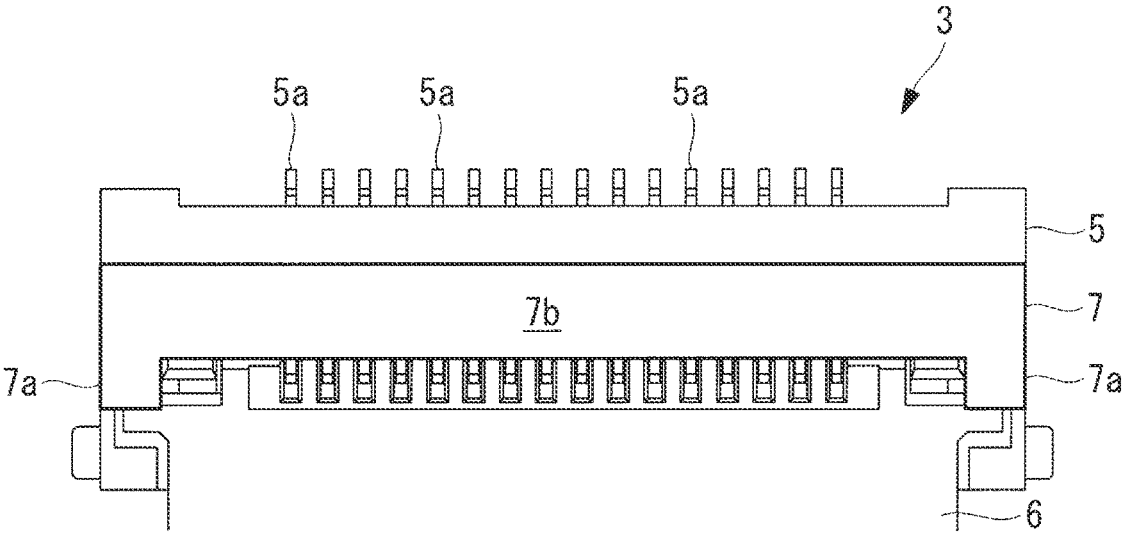
FIG. 2 is a plan view illustrating a connector according to one embodiment of the present invention.

As illustrated in FIG. 2, each connector 3 includes a main body 5 and an actuator 6.

The main body 5 is formed into an approximately wide rectangular shape in plan view. The main body 5 has many terminals 5*a* electrically connected to pattern wiring on the side of the board 1.

The actuator 6 is formed into an approximately wide rectangular shape in plan view. The actuator 6 is connected to the main body 5 to be movable relative to the main body 5 to sandwich a flat cable 8 in cooperation with the main body 5 (for example, see FIG. 3A) and retain the flat cable 8 in a connecting position. Specifically, the actuator 6 moves among a standing position (see FIG. 3A) of standing against the main body 5, a lying position (see FIG. 3B) of being turned in the direction of arrow A1 from this standing position and laid, and a draw-in position (see FIG. 3C) of being drawn into the side of the main body 5 from this lying position in a direction of arrow A2. Thus, the actuator 6 moves with two actions, i.e., turning action (see arrow A1 in FIG. 3B) and sliding action (see arrow A2 in FIG. 3C). An unillustrated turning shaft connected to the main body 5 is provided in the actuator 6, and this turning shaft is further slid in the draw-in direction (horizontal direction in FIGS. 3A to 3C). Note that a worker moves the actuator 6 to each position.

Figure 4A:
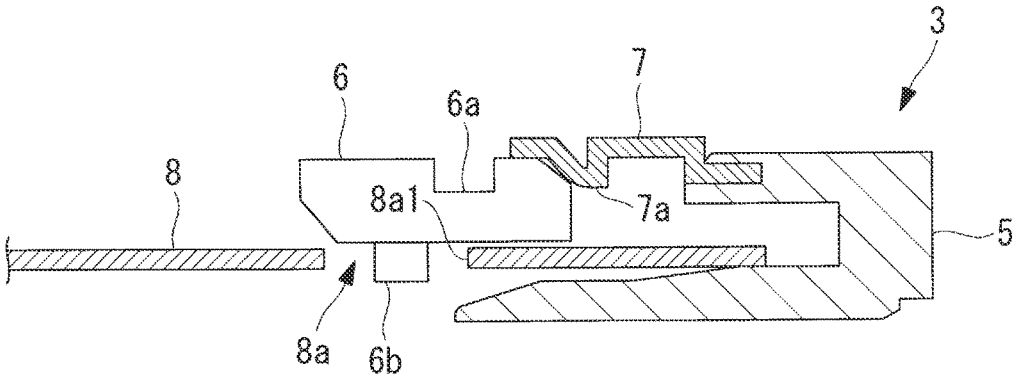
FIG. 4A is a sectional view illustrating a state in which an engaging portion of the actuator is in a first position of being inserted into a notch of a flat cable.

As illustrated in FIG. 2, the main body 5 includes a leaf spring 7, and the leaf spring 7 is fixed to the upper part of the main body 5. For example, the leaf spring 7 is made of metal such as stainless steel and has a covering section 7*b* provided substantially over the entire main body 5 in the width direction thereof. As illustrated in FIG. 4A, a fitting portion 7*a* is provided at each of both ends of the leaf spring 7 in the width direction, that is, both ends of the covering section 7*b*, respectively. The fitting portion 7*a* projects downward (toward the side of the actuator 6) to fit in a recessed portion 6*a* formed in the top face of the actuator 6 as illustrated in FIG. 4C.

As illustrated in FIGS. 4A to 4C and FIG. 5, an engaging portion 6*b* to project downward is provided at each of both ends of the actuator 6 in the width direction, respectively. Each engaging portion 6*b* is engaged with a rectangular notch 8*a* formed at each of both ends of the flat cable 8 such as an FFC (Flexible Flat Cable), respectively. In the plan view like in FIG. 5, the size of the engaging portion 6*b* is set smaller than the notch 8*a*. Specifically, the size of the engaging portion 6*b* in the draw-in direction of the engaging portion 6*b* (the direction of arrow A5 in FIG. 5) is set smaller than the size of the notch 8*a* in the draw-in direction.

Figure 6A:
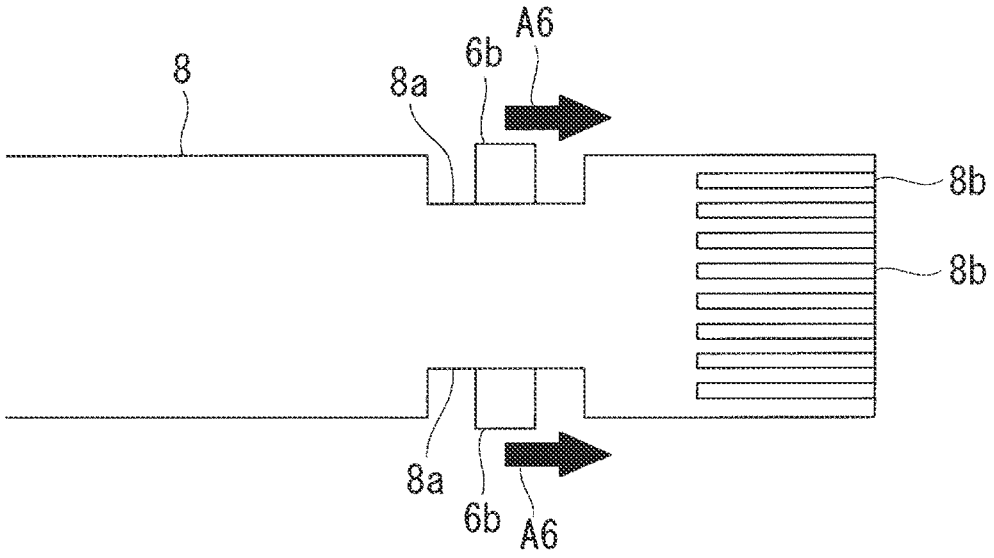
FIG. 6A is a plan view illustrating a state in which each engaging portion of the actuator is inserted in each notch of the flat cable.
Figure 6B:
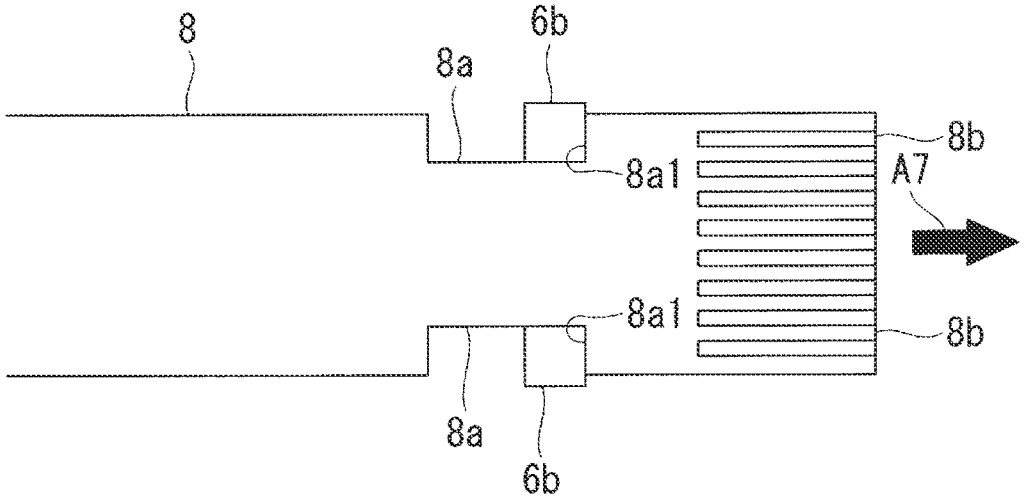
FIG. 6B is a plan view illustrating a state in which each engaging portion of the actuator is engaged with each notch of the flat cable.

As illustrated in FIG. 6A, after each engaging portion 6*b* is inserted in each notch 8*a* of the flat cable 8, the engaging portion 6*b* abuts against a front edge 8*a*1 of the notch 8*a* as illustrated in FIG. 6B to draw in the flat cable 8. Note that reference numeral 8*b* in FIG. 6A indicates terminals provided in the flat cable 8.

Figure 4B:
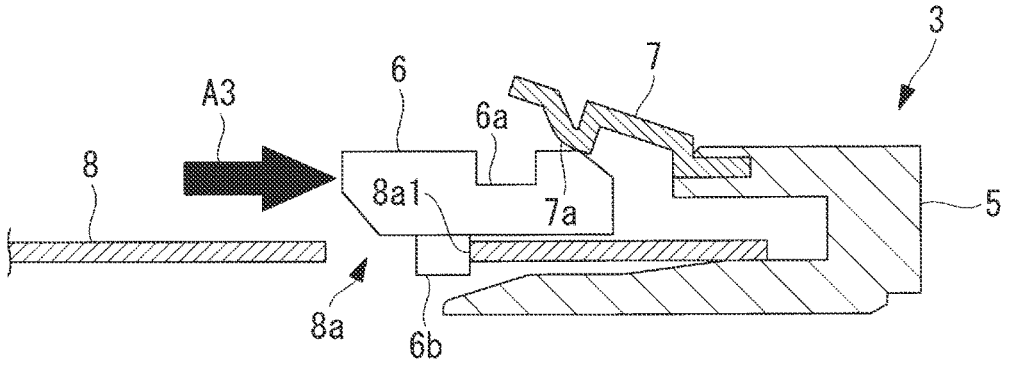
FIG. 4B is a sectional view illustrating a state in which the engaging portion of the actuator is engaged with the notch of the flat cable.
Figure 4C:
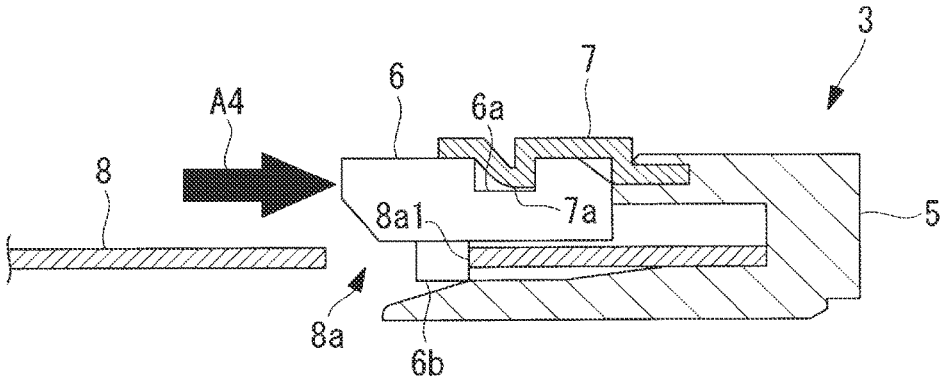
FIG. 4C is a sectional view illustrating a connecting state in a second position where the flat cable is connected to the connector.
Figure 5:
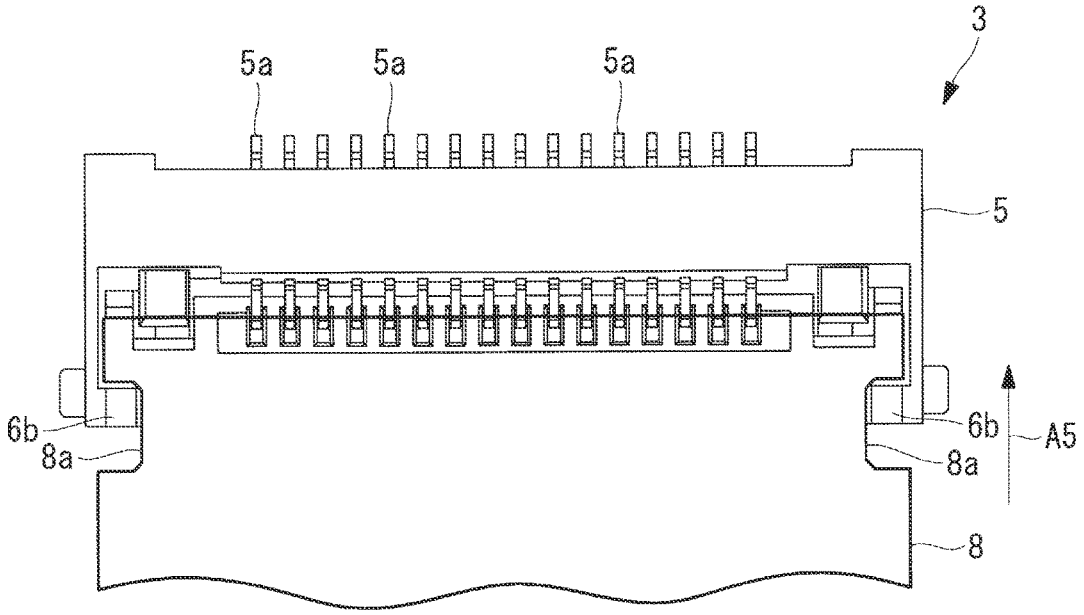
FIG. 5 is a plan view illustrating a state in which each engaging portion of the actuator is inserted in each notch of the flat cable.

Specifically, the engaging portion 6*b* is inserted into the notch 8*a* of the flat cable 8 (see FIG. 4A), and when the actuator 6 is slid to be drawn into the side of the main body 5, the engaging portion 6*b* abuts against the front edge 8*al* of the notch 8*a* (see FIG. 4B) to draw the flat cable 8 into the side of the main body 5 along with further slide movement of the actuator 6 (see FIG. 4C).

Next, operation to connect the flat cable 8 to the connector 3 will be described.

Figure 3A:
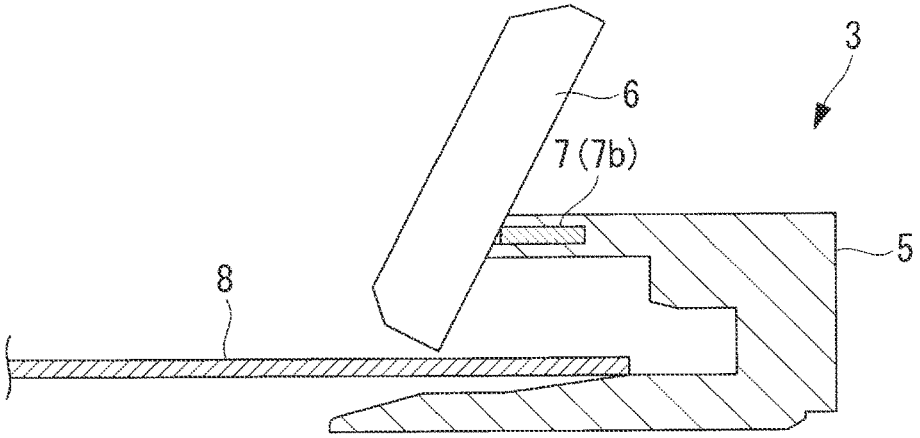
FIG. 3A is a sectional view illustrating a standing state of an actuator.

First, as illustrated in FIG. 3A, the tip of the flat cable 8 is inserted between the actuator 6 in the standing state and the main body 5.

Figure 3B:
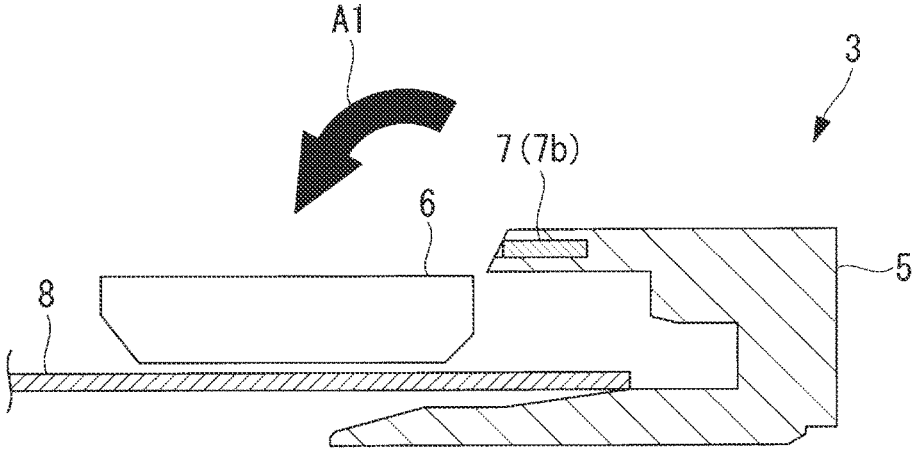
FIG. 3B is a sectional view illustrating a lying state of the actuator.

Then, as illustrated in FIG. 3B, the actuator 6 is turned in the direction of arrow A1 and put into the lying state. At this time, as illustrated in FIG. 4A and FIG. 6A, each engaging portion 6*b* of the actuator 6 is inserted into each of the notches 8*a* formed on both sides of the flat cable 8 (this position is called a "first position").

Figure 3C:
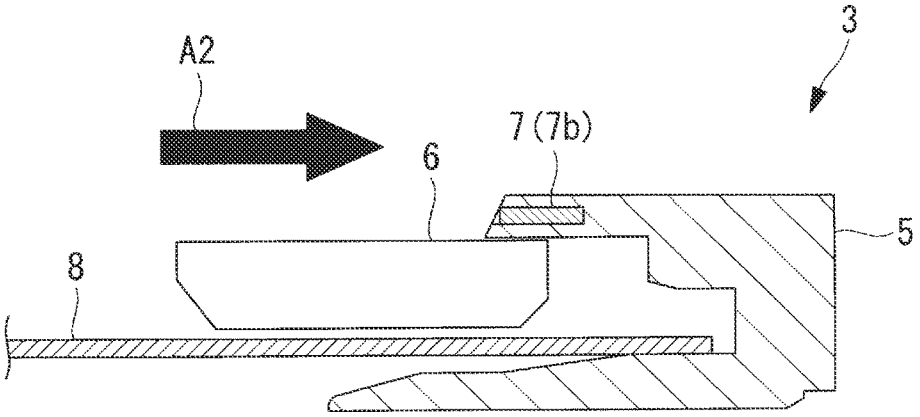
FIG. 3C is a sectional view illustrating a state in which the actuator is drawn into the side of a main body.

Next, the actuator 6 is slid toward the side of the main body 5 (arrow A2 in FIG. 3C, arrow A3 in FIG. 4B, and arrow A6 in FIG. 6A). This causes the engaging portion 6*b* of the actuator 6 to abut against the front edge 8*al* of the notch 8*a* of the flat cable 8 (FIG. 4B and FIG. 6B) to draw the flat cable 8 into the side of the main body 5 (arrow A4 in FIG. 4C and arrow A7 in FIG. 6B). Concurrently, as illustrated in FIG. 4B and FIG. 4C, the fitting portion 7*a* of the leaf spring 7 crosses over a front slant face of the actuator 6 and is fitted into the recessed portion 6*a* of the actuator 6. This causes the actuator 6 to be fixed to the main body 5 and the flat cable 8 to be retained in the connecting position securely in a state of being sandwiched between the actuator 6 and the main body 5 (this position is called a "second position"). At this time, since the flat cable 8 is moved accurately along the longitudinal direction of the flat cable 8 by means of the two engaging portions 6*b* provided on both sides of the actuator 6, the electrical connection between the flat cable 8 and the main body 5 is established correctly.

As described above, according to the embodiment, the following operational effects can be obtained.

The engaging portions 6*b* are provided in the actuator 6 to be engaged with the notches 8*a* formed on both sides of the flat cable 8. The actuator 6 is movable between the first position (see FIG. 4A), in which the engaging portions 6*b* are inserted into the notches 8*a*, and the second position (see FIG. 4C) in which the engaging portions 6*b* are engaged with the notches 8*a* to draw the flat cable 8 into the connecting position. Thus, when the flat cable 8 is drawn from the first position into the second position, the flat cable 8 can be led into the connecting position while keeping the attitude of the flat cable 8 constant by means of each engaging portion 6*b*, and hence the electrical connection between the flat cable 8 and the main body 5 can be established correctly.

As illustrated in FIG. 4C, the fitting portion 7*a* of the leaf spring 7 is fitted into the recessed portion 6*a* of the actuator 6 in the second position to enable the actuator 6 to be retained in the second position securely. Since this can restrict the movement of the actuator 6, the flat cable 8 can be prevented from coming off.

The leaf spring 7 having the fitting portion 7*a* is made of metal, and the covering section 7*b* that covers the main body 5 is provided, enabling improved shielding performance.

The invention claimed is:

1. A connector, comprising:

a main body having a terminal and to which a terminal of a flat cable having notches formed on both sides is electrically connectable;

an actuator that is connected to the main body so as to be moveable relative to the main body, the actuator having engaging portions engageable with the notches, respectively, to sandwich the flat cable with the main body and to retain the flat cable in a connecting position; and wherein the actuator is configured to insert the engaging portions into the notches in a first position and move to a second position so that the engaging portions are engaged with the notches to draw the flat cable into the connecting position.

2. The connector according to claim 1, wherein the main body includes at least a fitting portion to be fitted, in the second position, into a recessed portion in the actuator.

3. The connector according to claim 2, wherein the fitting portion is made of metal and has a covering section to cover the main body.

4. An electronic device comprising the connector according to claim 1.

* * * * *